US011355053B2

(12) United States Patent
Kim et al.

(10) Patent No.: US 11,355,053 B2
(45) Date of Patent: Jun. 7, 2022

(54) SOURCE DRIVER AND DISPLAY DEVICE HAVING THE SAME

(71) Applicant: Samsung Display Co., Ltd., Yongin-si (KR)

(72) Inventors: Won Tae Kim, Yongin-si (KR); Ji Hye Kim, Yongin-si (KR); Jae Hyeon Jeon, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/709,666

(22) Filed: Dec. 10, 2019

(65) Prior Publication Data

US 2020/0335027 A1 Oct. 22, 2020

(30) Foreign Application Priority Data

Apr. 19, 2019 (KR) ..... 10-2019-0046131

(51) Int. Cl.
*G09G 3/36* (2006.01)
*G09G 3/20* (2006.01)

(52) U.S. Cl.
CPC ..... *G09G 3/2007* (2013.01); *G09G 2310/027* (2013.01); *G09G 2310/0267* (2013.01); *G09G 2310/0291* (2013.01); *G09G 2310/08* (2013.01); *G09G 2320/103* (2013.01)

(58) Field of Classification Search
CPC .. G09G 3/3685; G09G 3/3688; G09G 3/2007; G09G 2310/0267; G09G 2310/027; G09G 2310/0291; G09G 2310/08; G09G 2320/103; G09G 3/3275
USPC ..... 345/100
See application file for complete search history.

(56) References Cited

U.S. PATENT DOCUMENTS

| | | | | |
|---|---|---|---|---|
| 5,808,596 | A * | 9/1998 | Kim | G09G 3/3611 345/100 |
| 6,816,144 | B2 * | 11/2004 | Tsuchi | G09G 3/3688 345/100 |
| 9,754,549 | B2 | 9/2017 | Kwon et al. | |
| 10,204,547 | B2 | 2/2019 | Park | |
| 2009/0009452 | A1 * | 1/2009 | Sunohara | G09G 3/3688 345/87 |
| 2011/0025656 | A1 | 2/2011 | Huang | |
| 2015/0084944 | A1 | 3/2015 | Kang et al. | |
| 2017/0287429 | A1 * | 10/2017 | Kong | G09G 3/3688 |

FOREIGN PATENT DOCUMENTS

| | | |
|---|---|---|
| KR | 10-2015-0033156 A | 4/2015 |
| KR | 10-2016-0040010 A | 4/2016 |
| KR | 10-2017-0000023 A | 1/2017 |

* cited by examiner

*Primary Examiner* — Roy P Rabindranath
(74) *Attorney, Agent, or Firm* — Lewis Roca Rothgerber Christie LLP

(57) ABSTRACT

A source driver includes a plurality of output buffers configured to output data signals respectively corresponding to a plurality of data lines, and an output controller configured to control a timing at which each of the data signals corresponding to second image data is transferred from the output buffers to the data lines based on a difference between first image data and the second image data.

18 Claims, 9 Drawing Sheets

SOURCE DRIVER AND DISPLAY DEVICE HAVING THE SAME

CROSS-REFERENCE TO RELATED APPLICATION

This application claims priority to, and the benefit of, Korean patent application No 10-2019-0046131 filed on Apr. 19, 2019, the entire disclosure of which is incorporated herein by reference.

BACKGROUND

1. Field

The present disclosure generally relates to a source driver, and to a display device having the same.

2. Related Art

A display device includes a display panel and a panel driver. The display panel includes a plurality of pixels. The panel driver includes a scan driver that is configured to supply a scan signal to the pixels, and a source driver that is configured to supply a data signal to the pixels.

The source driver includes output buffers that are respectively coupled to a plurality of data lines. A DC power source is supplied to the output buffers to drive the output buffers. A voltage of the DC power source may be changed (e.g., due to a voltage drop) by a pattern, grayscale, etc. of an image to be displayed. The charge amount or charge rate of data signals supplied from the output buffers to the data lines may be decreased due to the change in voltage of the DC power source.

SUMMARY

Embodiments disclosed herein provide a source driver that is configured to control timings at which data signals are transferred to data lines according to a variation in image data. Embodiments disclosed herein also provide a display device having the source driver.

In accordance with an aspect of the present disclosure, there is provided a source driver including a plurality of output buffers configured to output data signals respectively corresponding to a plurality of data lines, and an output controller configured to control a timing at which each of the data signals corresponding to second image data is transferred from the output buffers to the data lines based on a difference between first image data and the second image data.

The first image data may correspond to a data signal supplied to a pixel in a (k−1)th pixel row, wherein the second image data corresponds to a data signal supplied to a pixel in a kth pixel row, k being a natural number that is greater than 1.

The output controller may include a delay determiner configured to output an output delay signal based on results obtained by comparing the first image data and the second image data with a threshold reference, and a delay switch coupled between an output terminal of one of the output buffers and one of the data lines, and configured to be turned off in response to the output delay signal.

When a grayscale difference between the first image data and the second image data is less than a reference difference, the delay determiner may be configured to output the output delay signal.

When the grayscale difference between the first image data and the second image data is greater than or equal to the reference difference, the delay switch may be configured to maintain a turn-on state.

A period in which the delay switch is turned off may be shorter than one horizontal period.

When the delay switch is turned off, an output buffer corresponding to the delay switch may be configured to have an electrically high-impedance state from a data line corresponding thereto.

When the first image data and the second image data are equal to or greater than a first reference grayscale, the delay determiner may be configured to output the output delay signal.

When the first image data and the second image data are equal to or less than a second reference grayscale, the delay determiner may be configured to output the output delay signal, wherein the second reference grayscale is greater than the first reference grayscale.

The delay switch may be configured to be turned off during a delay period in response to the output delay signal.

When one of the first image data and the second image data is less than the first reference grayscale while the other of the first image data and the second image data is greater than the second reference grayscale, the delay switch may be configured to maintain a turn-on state.

The output controller may further include a pre-charge switch coupled between the one of the data lines and a power source, and is configured to be turned on in response to the output delay signal.

During a delay period in which the delay switch is turned off, a voltage of the power source may be supplied to a data line corresponding to the pre-charge switch among the data lines.

In accordance with another aspect of the present disclosure, there is provided a display device including a display panel including a plurality of pixels, a scan driver configured to supply a scan signal to the pixels in units of pixel rows, and a source driver configured to supply data signals to the pixels in response to the scan signal, and including a plurality of output buffers configured to output the data signals to a plurality of data lines, respectively, and an output controller configured to control a timing at which each of the data signals corresponding to current image data is transferred from the output buffers to the data lines based on a difference between previous image data and the current image data.

The previous image data may correspond to a data signal supplied to a pixel in a (k−1)th pixel row, wherein the current image data corresponds to a data signal supplied to a pixel in a kth pixel row, k being a natural number that is greater than 1.

The output controller may include a delay determiner configured to output an output delay signal based on a result obtained by comparing a grayscale difference between the previous image data and the current image data with a reference difference, and a delay switch coupled between an output terminal of one of the output buffers and one of the data lines, and configured to be turned off in response to the output delay signal.

When the grayscale difference is less than the reference difference, the delay determiner may be configured to output the output delay signal.

When the grayscale difference is greater than or equal to the reference difference, the delay switch may be configured to maintain a turn-on state.

When the delay switch is turned off, an output buffer corresponding to the delay switch may be configured to have an electrically high-impedance from a data line corresponding thereto.

In accordance with the present disclosure, the source driver, and the display device having the same, can control at least one of the output buffers to have a temporarily high-impedance state during the delay period based on a variation between image data of a previous pixel row (e.g., the (k−1)th pixel row) and image data of a current pixel row (e.g., the kth pixel row). Accordingly, the equivalent resistance (or load) with respect to a first power source may be decreased, so that the voltage fluctuation of the first power source for driving the output buffers can be reduced or minimized. Thus, the voltage level change rate (slew rate or voltage charge rate) of a data signal (data line voltage) with respect to a grayscale change between pixel rows can be increased, and a display defect, such as image dragging or image distortion, can be minimized or reduced. Accordingly, the image quality of the display device can be improved.

BRIEF DESCRIPTION OF THE DRAWINGS

Embodiments will now be described more fully hereinafter with reference to the accompanying drawings.

DETAILED DESCRIPTION

Figure 1:
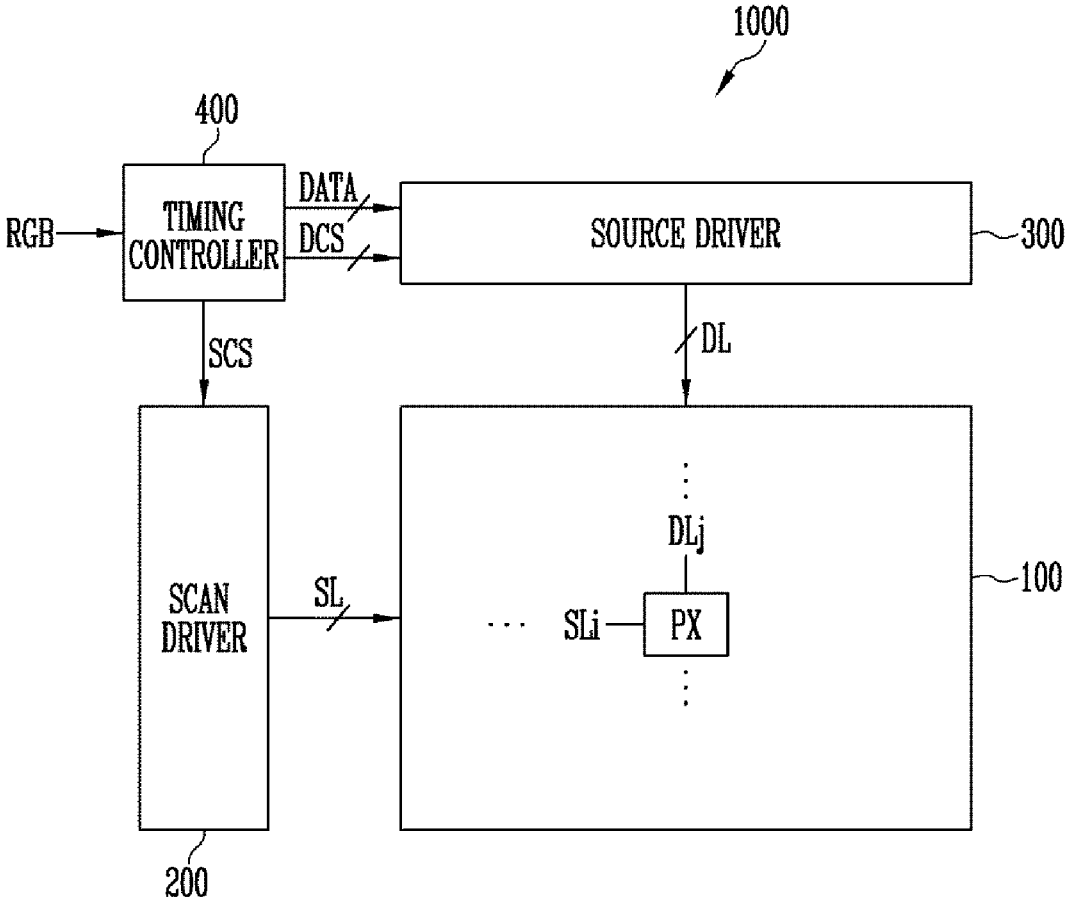
FIG. 1 is a block diagram illustrating a display device in accordance with an embodiment of the present disclosure.

Features of the inventive concept and methods of accomplishing the same may be understood more readily by reference to the detailed description of embodiments and the accompanying drawings. Hereinafter, embodiments will be described in more detail with reference to the accompanying drawings. The described embodiments, however, may be embodied in various different forms, and should not be construed as being limited to only the illustrated embodiments herein. Rather, these embodiments are provided as examples so that this disclosure will be thorough and complete, and will fully convey the aspects and features of the present inventive concept to those skilled in the art. Accordingly, processes, elements, and techniques that are not necessary to those having ordinary skill in the art for a complete understanding of the aspects and features of the present inventive concept may not be described.

Unless otherwise noted, like reference numerals denote like elements throughout the attached drawings and the written description, and thus, descriptions thereof will not be repeated. Further, parts not related to the description of the embodiments might not be shown to make the description clear. In the drawings, the relative sizes of elements, layers, and regions may be exaggerated for clarity.

Various embodiments are described herein with reference to sectional illustrations that are schematic illustrations of embodiments and/or intermediate structures. As such, variations from the shapes of the illustrations as a result, for example, of manufacturing techniques and/or tolerances, are to be expected. Further, specific structural or functional descriptions disclosed herein are merely illustrative for the purpose of describing embodiments according to the concept of the present disclosure. Thus, embodiments disclosed herein should not be construed as limited to the particular illustrated shapes of regions, but are to include deviations in shapes that result from, for instance, manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the drawings are schematic in nature and their shapes are not intended to illustrate the actual shape of a region of a device and are not intended to be limiting. Additionally, as those skilled in the art would realize, the described embodiments may be modified in various different ways, all without departing from the spirit or scope of the present disclosure.

In the detailed description, for the purposes of explanation, numerous specific details are set forth to provide a thorough understanding of various embodiments. It is apparent, however, that various embodiments may be practiced without these specific details or with one or more equivalent arrangements. In other instances, well-known structures and devices are shown in block diagram form in order to avoid unnecessarily obscuring various embodiments.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

It will be understood that when an element, layer, region, or component is referred to as being "on," "connected to," or "coupled to" another element, layer, region, or component, it can be directly on, connected to, or coupled to the other element, layer, region, or component, or one or more intervening elements, layers, regions, or components may be present. However, "directly connected/directly coupled" refers to one component directly connecting or coupling another component without an intermediate component. Meanwhile, other expressions describing relationships between components such as "between," "immediately between" or "adjacent to" and "directly adjacent to" may be construed similarly. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present disclosure. As used herein, the singular forms "a" and "an" are intended to include the plural forms as well, unless the context clearly indicates otherwise. It will be further understood that the terms "comprises," "comprising," "have," "having," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

As used herein, the term "substantially," "about," "approximately," and similar terms are used as terms of approximation and not as terms of degree, and are intended to account for the inherent deviations in measured or calculated values that would be recognized by those of ordinary skill in the art. "About" or "approximately," as used herein, is inclusive of the stated value and means within an acceptable range of deviation for the particular value as determined by one of ordinary skill in the art, considering the measurement in question and the error associated with measurement of the particular quantity (e.g., the limitations of the measurement system). For example, "about" may mean within one or more standard deviations, or within ±30%, 20%, 10%, 5% of the stated value. Further, the use of "may" when describing embodiments of the present disclosure refers to "one or more embodiments of the present disclosure."

When a certain embodiment may be implemented differently, a specific process order may be performed differently from the described order. For example, two consecutively described processes may be performed substantially at the same time or performed in an order opposite to the described order.

The electronic or electric devices and/or any other relevant devices or components according to embodiments of the present disclosure described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the embodiments of the present disclosure.

Unless otherwise defined, all terms (including technical and scientific terms) used herein have the same meaning as commonly understood by one of ordinary skill in the art to which the present inventive concept belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

FIG. 1 is a block diagram illustrating a display device in accordance with an embodiment of the present disclosure.

Referring to FIG. 1, the display device 1000 may include a display panel 100, a scan driver 200, a source driver 300 (or data driver), and a timing controller 400.

The display device 1000 may be implemented with a self-luminescent display device including a plurality of self-luminescent devices. For example, the display device 1000 may be an organic light emitting display device including organic light emitting devices, or may be a display device including inorganic light emitting devices. However, this is merely illustrative, and the display device 1000 may be implemented with a liquid crystal display device, a plasma display device, a quantum dot display device, etc.

The display panel 100 may include a plurality of scan lines SL and a plurality of data lines DL, and may include a plurality of pixels PX respectively coupled to the scan lines SL and the data lines DL. In an embodiment, a pixel PX at an ith row and at a jth column (i and j being natural numbers) may be coupled to a scan line SLi corresponding to an ith pixel row, and to a data line DLj corresponding to a jth pixel column.

The timing controller 400 may generate a first control signal SCS and a second control signal DCS corresponding to externally supplied synchronization signals. The first control signal SCS may be supplied to the scan driver 200, and the second control signal DCS may be supplied to the source driver 300. Also, the timing controller 400 may realign externally supplied input image data RGB into image data DATA, and may supply the image data DATA to the source driver 300.

A scan start signal and clock signals may be included in the first control signal SCS. The scan start signal may control a first timing of a scan signal. The clock signals may be used to shift the scan start signal.

A source start pulse and clock signals may be included in the second control signal DCS. The source start pulse may control a sampling start time of data. The clock signals may be used to control a sampling operation.

The scan driver 200 may receive the first control signal SCS from the timing controller 400, and may supply a scan signal to the scan lines SL in response to the first control signal SCS. For example, the scan driver 200 may sequentially supply the scan signal to the scan lines SL. When the scan signal is sequentially supplied, the pixels PX may be selected in units of horizontal lines (or pixel rows) (e.g., line by line).

The scan signal may be set to a turn-on level (e.g., a logic high voltage). A transistor that is included in the pixel P, and that receives the scan signal, may be set to a turn-on state when the scan signal is supplied.

The source driver 300 may receive the second control signal and the image data DATA from the timing controller 400. The source driver 300 may supply a data signal to the data lines DL in response to the second control signal DCS. The data signal supplied to the data lines DL may be supplied to pixels PX selected by the scan signal. To this end, the source driver 300 may supply the data signal to the data lines DL in synchronization with the scan signal.

In an embodiment, the source driver 300 may include a plurality of output buffers configured to respectively output data signals, which correspond to the pixel rows, to the data lines DL, and may include an output controller configured to control timings at which data signals, which correspond to current image data, are respectively transferred from the output buffers to the data lines DL based on the difference between previous image data and the current image data. The previous image data may correspond to a data signal supplied to a pixel (e.g., a predetermined pixel) included in a previous pixel row (e.g., a (k−1)th pixel row (k being a natural number greater than 1)). The current image data may correspond to a data signal supplied to a pixel included in a current pixel row (e.g., a kth pixel row). The pixel of the previous pixel row, and the pixel of the current pixel row, are coupled to the same data line.

In an embodiment, the display device 1000 may further include an emission driver configured to supply an emission control signal to the pixels PX, and a power supply configured to supply power voltages (e.g., predetermined power voltages) to the pixels PX.

Figure 2:
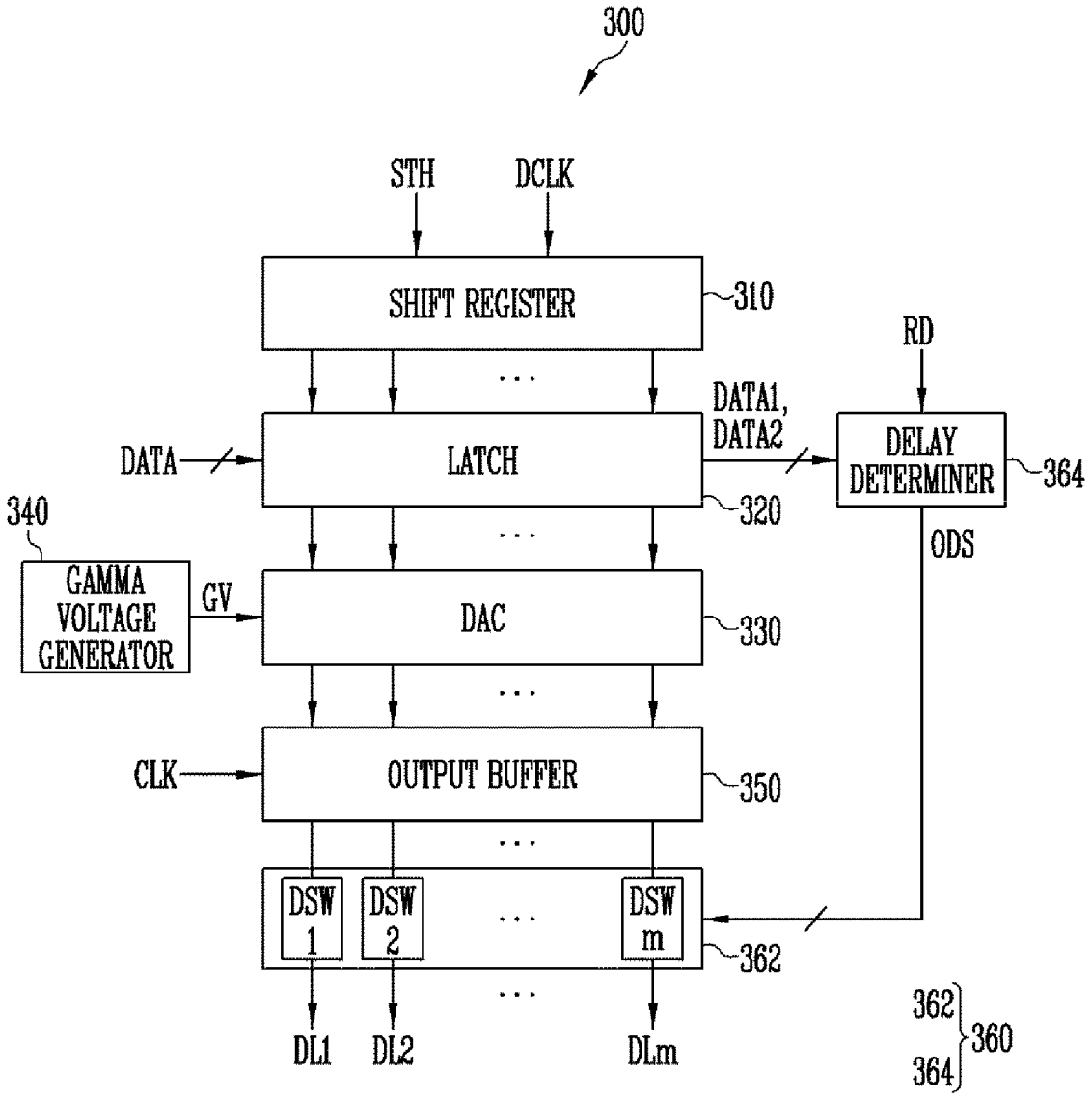
FIG. 2 is a block diagram illustrating a source driver in accordance with an embodiment of the present disclosure.

FIG. 2 is a block diagram illustrating a source driver in accordance with an embodiment of the present disclosure.

Referring to FIGS. 1 and 2, the source driver 300 may include a shift register 310, a latch 320, a Digital-Analog Converter (DAC) 330, a gamma voltage generator 340, output buffer(s) 350, and an output controller 360.

In some embodiments, the source driver 300 may be mounted in the form of a driving IC on the display panel 100. Alternatively, the source driver 300 may be integrated on the display panel 100.

The shift register 310 may receive a horizontal start signal STH and a data clock signal DCLK from a controller (e.g., a predetermined controller). The shift register 310 may generate a sampling signal by shifting the horizontal start signal STH in synchronization with the data clock signal DCLK.

The latch 320 may latch image data DATA in response to the sampling signal. The latch 320 may output the latched image data. The latch 320 may sequentially latch image data DATA in response to the sampling signal supplied from the shift register 310, and may supply the latched image data to the DAC 330.

The latch 320 has a size corresponding to a bit number of the image data DATA. In an embodiment, the latch 320 may include m sampling latches (m being a natural number) for respectively storing m digital image data DATA. The sampling latches may have a storage capacity corresponding to a bit number of the image data DATA, and may sequentially store digital image data signals in response to sampling signals.

In an embodiment, the latch 320 may further include holding latches. The holding latches may substantially simultaneously receive and store image data DATA from the sampling latches, and may substantially simultaneously supply sampled image data DATA stored in a previous period to the DAC 330.

In an embodiment, the latch 320 may compare image data with respect to consecutive scan lines (e.g., pixel rows). In another embodiment, a comparison operation on image data (e.g., DATA1 and DATA2) latched with respect to consecutive scan lines may be performed by a delay determiner 364 of the output controller 360. First image data DATA1 may correspond to a data signal supplied to a pixel included in a (k−1)th pixel row (k being a natural number greater than 1), and second image data DATA2 may correspond to a data signal supplied to a pixel included in a kth pixel row.

The DAC 330 may convert image data DATA that is latched into analog data signals based on gamma voltages GV. The converted analog data signals may be supplied to the output buffers 350.

The gamma voltage generator 340 may generate gamma voltages GV by using a plurality of gamma reference voltages. For example, the gamma voltages GV may be determined based on a gamma curve (e.g., a predetermined gamma curve, such as a 2.2 gamma curve or the like).

The output buffers 350 may output the data signals, which are output from the DAC 330, to data lines DL1 to DLm. For example, the output buffers 350 may output data signals corresponding to a corresponding pixel row to the data lines DL1 to DLm in response to a predetermined clock signal CLK.

The output controller 360 may individually control timings at which data signals corresponding to the second image data DATA2 are respectively transferred to the data lines DL1 to DLm from the output buffers 350. The first and second image data DATA1 and DATA2 are latched image data corresponding to pixel rows that are adjacent to each other. In an embodiment, the output controller 360 may include the delay determiner 364 and a plurality of delay switches 362 (e.g., DSW1 to DSWm) corresponding to each of the output buffers 350.

The delay switches 362 may be respectively coupled between output terminals of the output buffers 350 and the data lines DL1 to DLm. Each of the delay switches 362 may be turned off in response to an output delay signal ODS. The output delay signal ODS may be individually supplied to the delay switches 362 according to a variation in image data corresponding thereto.

In an embodiment, when a first delay switch DSW1 coupled to a first data line DL1 is turned off, a first output buffer corresponding to the first delay switch DSW1 and the first data line DL1 may be electrically disconnected (open circuit). For example, the first output buffer may have an electrically high-impedance (Hi-Z) state. Each of the delay switches 362 may be turned off during a period (e.g., a predetermined period) in response to the output delay signal ODS.

The delay determiner 364 may compare the first and second image data DATA1 and DATA2 with a threshold reference RD (e.g., a predetermined threshold reference), and may output the output delay signal ODS based on the comparison result. For example, when data signals corresponding to each of the first and second image data DATA1 and DATA2 are supplied to the first data line DL1, the first image data DATA1 may be image data corresponding to a pixel coupled to the first data line DL1 of the (k−1)th pixel row, and the second image data DATA2 may be image data corresponding to a pixel coupled to the first data line DL1 of the kth pixel row. That is, the result obtained by comparing the first image data DATA1 and the second image data DATA2 with the threshold reference RD may be understood as a grayscale variation between adjacent pixel rows.

For example, when the grayscale difference between the first and second image data DATA1 and DATA2 is less than a reference difference (e.g., a predetermined reference difference), the delay determiner 364 may output an output delay signal ODS corresponding to a respective delay switch. On the contrary, when the grayscale difference between the first and second image data DATA1 and DATA2 is greater than or equal to the reference difference, the delay determiner 364 does not output the output delay signal ODS to the corresponding delay switch. That is, the corresponding delay switch may maintain the turn-on state.

For example, when the grayscale difference between the first and second image data DATA1 and DATA2 is equal to or less than grayscale 200, the output delay signal ODS is output. When the grayscale difference between the first and second image data DATA1 and DATA2 is greater than the grayscale 200, the output delay signal ODS is not output.

As described above, when the image data variation (or grayscale difference) between adjacent pixels PX in the extending direction of a data line is relatively small, the output of a data signal supplied to a corresponding pixel may be further delayed than that of a data signal supplied to another pixel located on the same pixel row. Thus, the present embodiment can improve a charge rate (and slew rate) at which data signals, which are output from the output buffers 350, are charged to a desired voltage level.

Figure 3:
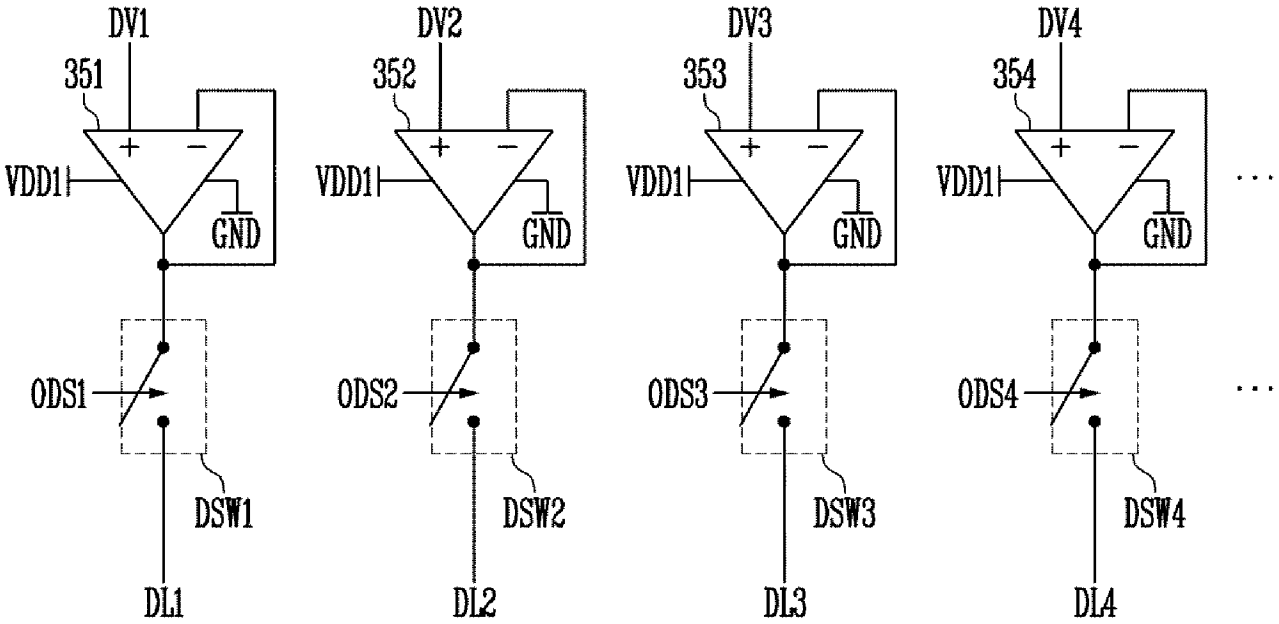
FIG. 3 is a diagram illustrating an example of a portion of output buffers and an output controller, which are included in the source driver shown in FIG. 2.

FIG. 3 is a diagram illustrating an example of a portion of the output buffers and the output controller, which are included in the source driver shown in FIG. 2.

Referring to FIGS. 2 and 3, first to fourth output buffers 351 to 354 may be coupled to first to fourth data lines DL1 to DL4, respectively. First to fourth delay switches DSW1 to DSW4 may be coupled between the first to fourth output buffers 351 to 354 and the first to fourth data lines DL1 to DL4, respectively.

Each of the first to fourth output buffers 351 to 354 may be a voltage follower type buffer amplifier. The first to fourth output buffers 351 to 354 may respectively receive first to fourth analog data signals, which are obtained by converting digital image data, and may output the first to fourth data signals. In addition, a voltage of a first power source VDD1 may be supplied to the first to fourth output buffers 351 to 354 so as to perform an operation of the first to fourth output buffers 351 to 354. That is, the first power source VDD1 may be output as a high-potential voltage for driving of the output buffer 350.

A voltage level of data signals supplied to the output buffers 350 may be changed depending on an image pattern or image load. An unintended fluctuation (or distortion) may occur in the voltage of the first power source VDD1 due to influence of a change in data signals.

For example, when a voltage drop of the first power source VDD1 occurs, the output of the output buffers 350 may become unstable. For example, the voltage of the first power source VDD1 is lowered, the change rate (e.g., the slew rate) of a voltage level of the first to fourth data signals DV1 to DV4, which are respectively output from the first to fourth output buffers 351 to 354, may be decreased. Accordingly, the first to fourth data signals DV1 to DV4 do not reach a desired voltage level, and may be provided to pixels through the first to fourth data lines DL1 to DL4. Therefore, image quality may be deteriorated.

The source driver 300, and the display device 1000 having the same, in accordance with the embodiment of the present disclosure, include the output controller 360 that is configured to separate output timings of the respective output buffers 350, so that the output of the first power source VDD1 can be stabilized.

The first to fourth delay switches DSW1 to DSW4 may be coupled between output terminals of the first to fourth output buffers 351 to 354 and the first to fourth data lines DL1 to DL4, respectively. The first to fourth delay switches DSW1 to DSW4 may be respectively turned on or turned off based on first to fourth output delay signals ODS1 to ODS4. For example, while the first output signal ODS1 is being output, the first delay switch DSW1 may be turned off, and the first data line DL1 may be electrically disconnected from the first output buffer 351 (or may have a high-impedance state).

Whether the first to fourth output delay signals ODS1 to ODS4 are to be output may be determined by a difference (or grayscale variation) between the first and second image data DATA1 and DATA2. The output controller 360 may determine the output of the first to fourth output delay signals ODS1 to ODS4, based on the difference between the first and second image data DATA1 and DATA2.

Figure 4:
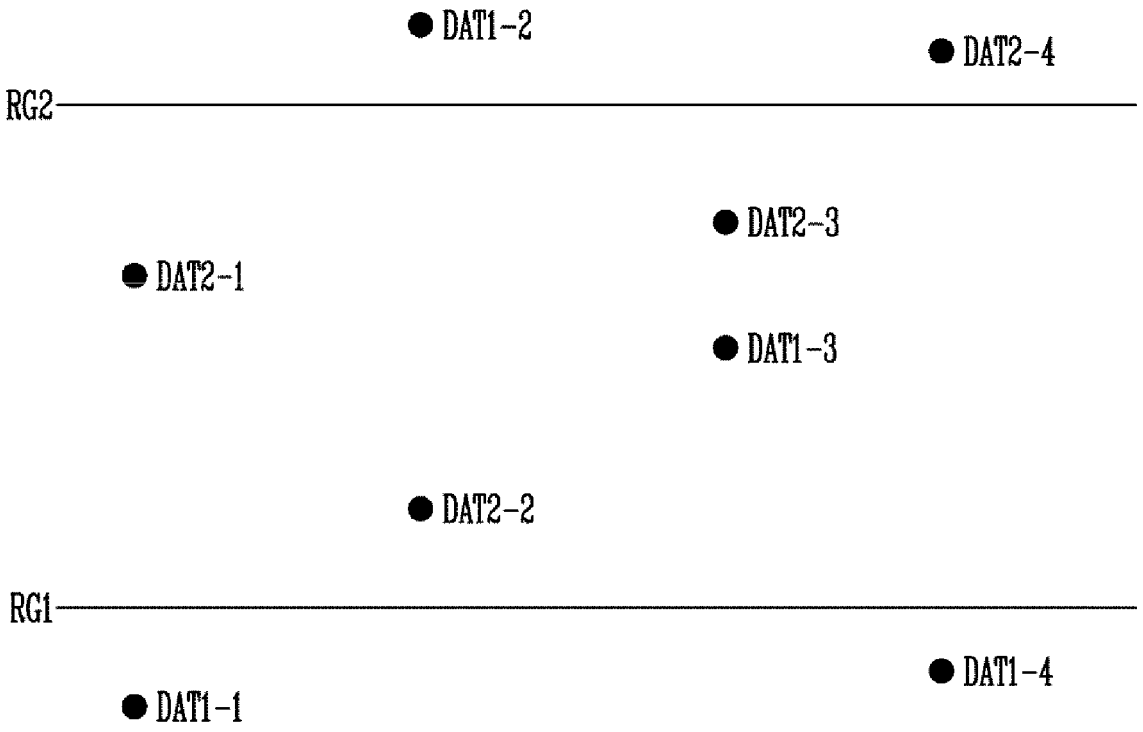
FIG. 4 is a diagram illustrating an example of image data corresponding to data signals supplied to the output buffers shown in FIG. 3.
Figure 5:
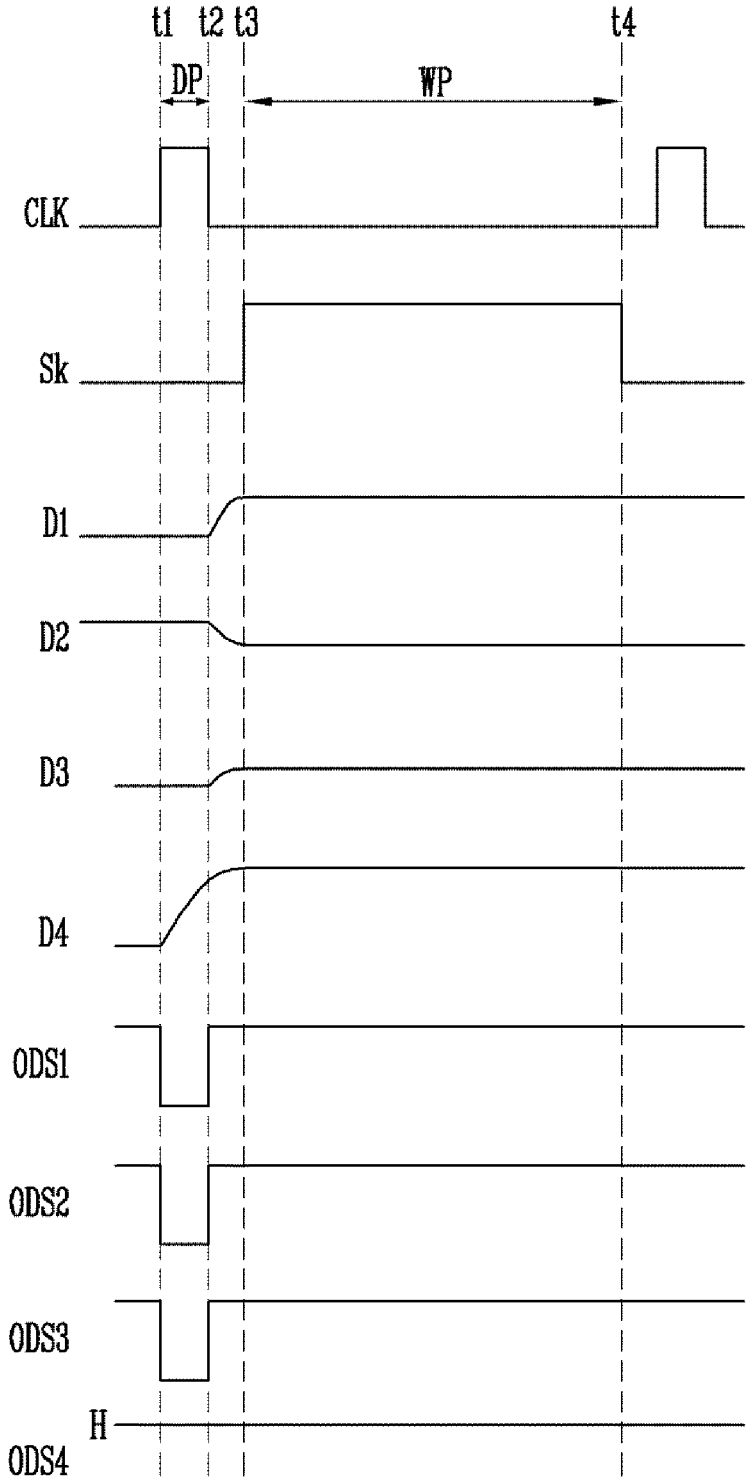
FIG. 5 is a waveform diagram illustrating an example of an operation of the output buffers and the output controller, shown in FIG. 3, which corresponds to the image data shown in FIG. 4.

FIG. 4 is a diagram illustrating an example of image data corresponding to data signals supplied to the output buffers shown in FIG. 3. FIG. 5 is a waveform diagram illustrating an example of an operation of the output buffers and the output controller (shown in FIG. 3), which corresponds to the image data shown in FIG. 4.

Referring to FIGS. 2 to 5, the delay determiner 364 included in the output controller 360 may determine the first to fourth output delay signals ODS1 to ODS4 based on respective differences between previous image data DAT1-1, DAT1-2, DAT1-3, and DAT1-4 and current image data DAT2-1, DAT2-2, DAT2-3, and DAT2-4.

The previous image data DAT1-1, DAT1-2, DAT1-3, and DAT1-4 may respectively correspond to first to fourth data signals DV1 to DV4 supplied to the kth pixel row. In FIG. 5, first to fourth data signals DV1 to DV4, which are output after a delay period DP, are respectively generated from the current image data DAT2-1, DAT2-2, DAT2-3, and DAT2-4.

In an embodiment, a first reference grayscale RG1 and a second reference grayscale RG2 may be set in the delay determiner 364. The second reference grayscale RG2 may be greater than the first reference grayscale RG1. For example, the first reference grayscale RG1 may be set as grayscale 10, and the second reference grayscale RG2 may be set as grayscale 200.

The delay determiner 364 may compare the previous image data DAT1-1, DAT1-2, DAT1-3, and DAT1-4 and the current image data DAT2-1, DAT2-2, DAT2-3, and DAT2-4 respectively with the first and second reference grayscales RG1 and RG2. First previous image data DAT1-1 and first current image data DAT2-1 may correspond to the first data signal DV1. Second previous image data DAT1-2 and second current image data DAT2-2 may correspond to the second data signal DV2. Third previous image data DAT1-3 and third current image data DAT2-3 may correspond to the third data signal DV3. Fourth previous image data DAT1-4 and fourth current image data DAT2-4 may correspond to the fourth data signal DV4.

In an embodiment, when the previous image data and the current image data are equal to or less than the second reference grayscale RG2, the delay determiner 364 may output an output delay signal ODS. As shown in FIG. 4, when the first previous image data DAT1-1 and the first current image data DAT2-1 are equal to or less than the second reference grayscale RG2, the delay determiner 364 may output the first output delay signal ODS1. Accordingly, the first delay switch DSW1 may have a turn-off state during the delay period DP in which the first output delay signal ODS1 is output. Similarly, because the third previous image data DAT1-3 and the third current image data DAT2-3 are equal to or less than the second reference grayscale RG2, the delay determiner 364 may output the third output delay signal ODS3.

In an embodiment, when the previous image data and the current image data are equal to or greater than the first reference grayscale RG1, the delay determiner 364 may output an output delay signal ODS. As shown in FIG. 4, because the second previous image data DAT1-2 and the second current image data DAT2-2 are equal to or greater than the first reference grayscale RG1, the delay determiner 364 may output the second output delay signal ODS2. Accordingly, the second delay switch DSW2 may have the turn-off state during the delay period DP. In an embodiment, the period in which the second delay switch DSW2 has the turn-off state may be shorter than one horizontal period. For example, the period in which the second delay switch DSW2 has the turn-off state may be about 10 ns to about 40 ns.

In an embodiment, when one of the previous image data and the current image data is less than the first reference grayscale RG1, and the other of the previous image data and the current image data is greater than the second reference grayscale RG2, a corresponding delay switch may maintain the turn-on state. For example, as shown in FIG. 4, because the fourth previous image data DAT1-4 is greater than the second reference grayscale RG2, and the fourth current image data DAT2-4 is less than the first reference grayscale RG1, the delay determiner 364 does not output the fourth output delay signal ODS4.

FIG. 5 shows outputs of signals according to the image data shown in FIG. 4. As shown in FIG. 5, when a scan signal Sk is supplied to the kth pixel row, the first to fourth data signals DV1 to DV4 may be written in some pixels of the kth pixel row through the first to fourth data lines DL1 to DL4, respectively.

A transistor of the pixel may be turned on by a logic high level of the scan signal Sk. In addition, the first to fourth delay switches DSW1 to DSW4 may be respectively turned off by a logic low level of the first to fourth output delay signals ODS1 to ODS4, and may be respectively turned on by a logic high level of the first to fourth output delay signals ODS1 to ODS4. In FIG. 5, a case where the first to fourth output delay signals ODS1 to ODS4 have the logic low level for turning off the first to fourth delay switches DSW1 to DSW4 will be described.

The clock signal CLK may determine a time at which data signals corresponding to each of the pixel rows are output from the output buffers 350.

At a first time t1, the clock signal CLK may be changed from a logic low level to a logic high level. Before the first time t1, first to fourth data line voltages D1 to D4 supplied to the first to fourth data lines DL1 to DL4 may correspond to image data (e.g., DAT1-1 to DAT1-4) of the (k−1)th pixel row.

At the first time t1, the first to fourth output buffers 351 to 354 may start outputting first to fourth data line voltage D1 to D4 corresponding to image data (e.g., DAT2-1 to DAT2-4) of the kth pixel row. In the present example, only the fourth delay switch DSW4 maintains the turn-on state. Accordingly, the fourth data line voltage D4 may be changed, or may begin to change, to correspond to the fourth current image data DAT2-4. The fourth data line voltage D4 corresponding to a large grayscale change generally uses a relatively long time for the purpose of a voltage change. Therefore, the fourth data signal DV4 may be supplied to the fourth data line DL4 from the first time t1.

At the first time t1, the first to third output delay signals ODS1 to ODS3 may be supplied to the first to third delay switches DSW1 to DSW3. The first to third output delay signals ODS1 to ODS3 may be supplied during the delay period DP. Because the first to third data signals DV1 to DV3 correspond to a relatively small grayscale change, the first to third data signals DV1 to DV3 have a relatively small voltage variation. Accordingly, the time that is suitable for a voltage change is shorter than that for which the fourth data line voltage D4 is changed. Therefore, during the delay period DP, the first to third output buffer 351 to 353 may respectively have a high-impedance (Hi-Z) state from the first to third data lines DL1 to DL3.

However, because the delay period DP is a relatively very short time of about 10 ns to about 40 ns, the existing data voltages supplied to the first to third data lines DL1 to DL3 may be maintained.

Because the first to third output buffers 351 to 353 have the Hi-Z state, the number of data lines DL coupled from the output buffers 350 is reduced during the delay period DP. Accordingly, an equivalent resistance (or load) with respect to the first power source VDD1 can be decreased during the delay period DP. Thus, the voltage drop or voltage fluctuation width of the first power source VDD1 is minimized or reduced, and the slew rate of a voltage output from the fourth output buffer 354 can be improved.

Subsequently, at a second time t2, the first to third output delay signals ODS1 to ODS3 may be changed from the logic low level to the logic high level. Although a case where a change time of the first to third output delay signals ODS1 to ODS3 is approximately equal to that of the clock signal CLK is illustrated in FIG. 5, the change time of the first to third output delay signals ODS1 to ODS3 is not limited thereto. For example, the time at which the first to third output delay signals ODS1 to ODS3 are changed from the logic low level to the logic high level may be between the first time t1 and the second time t2, or may be between the second time t2 and a third time t3.

In an embodiment, the delay period DP may be differently set with respect to the data lines depending on a variation in grayscale. For example, when the variation in grayscale becomes smaller, the pulse width of an output delay signal corresponding thereto (e.g., the width of a logic low level period of the output delay signal) may be decreased at an interval (e.g., a predetermined interval).

At the second time t2, the first to third delay switches DSW1 to DSW3 may be turned on, and the first to third output buffers 351 to 353 may be electrically coupled to the first to third data lines DL1 to DL3, respectively. Because the first to third data line voltages D1 to D3 have a small fluctuation width, the first to third data line voltages D1 to D3 may reach a voltage level corresponding to the first to third current image data DAT2-1 to DAT2-3 before the third time t3.

Because the voltage charging of the fourth data line voltage D4 is started from, or begins at, the first time t1, the fourth data line voltage D4 may sufficiently reach a voltage level (e.g., a target voltage) corresponding to the fourth current image data DAT2-4 before the third time t3.

Subsequently, a scan signal Sk corresponding to the kth pixel row may be supplied during a write period WP between the third time t3 and a fourth time t4, and first to fourth data line voltages D1 to D4 corresponding to the first to fourth current image data DAT2-1 to DAT2-4 may be supplied to the pixels of the kth pixel row during the write period WP.

The configuration and operation shown in FIGS. 3 to 5 can be applied (or expanded) to all of the data lines included in the display device 1000.

As described above, the source driver 300, and the display device 1000 having the same, in accordance with embodiments of the present disclosure can control at least some of the output buffers 350 to have the high-impedance state during the delay period DP based on a variation between image data of a previous pixel row and image data of a current pixel row. Accordingly, the equivalent resistance (or load) with respect to the first power source VDD1 is decreased, such that the voltage fluctuation of the first power source VDD1 for driving the output buffers 350 can be reduced or minimized. Thus, the voltage level change rate (slew rate or voltage charge rate) of a data signal (data line voltage) with respect to a grayscale change between pixel rows can be increased, and the image quality of the display device can be improved.

Figure 6A:
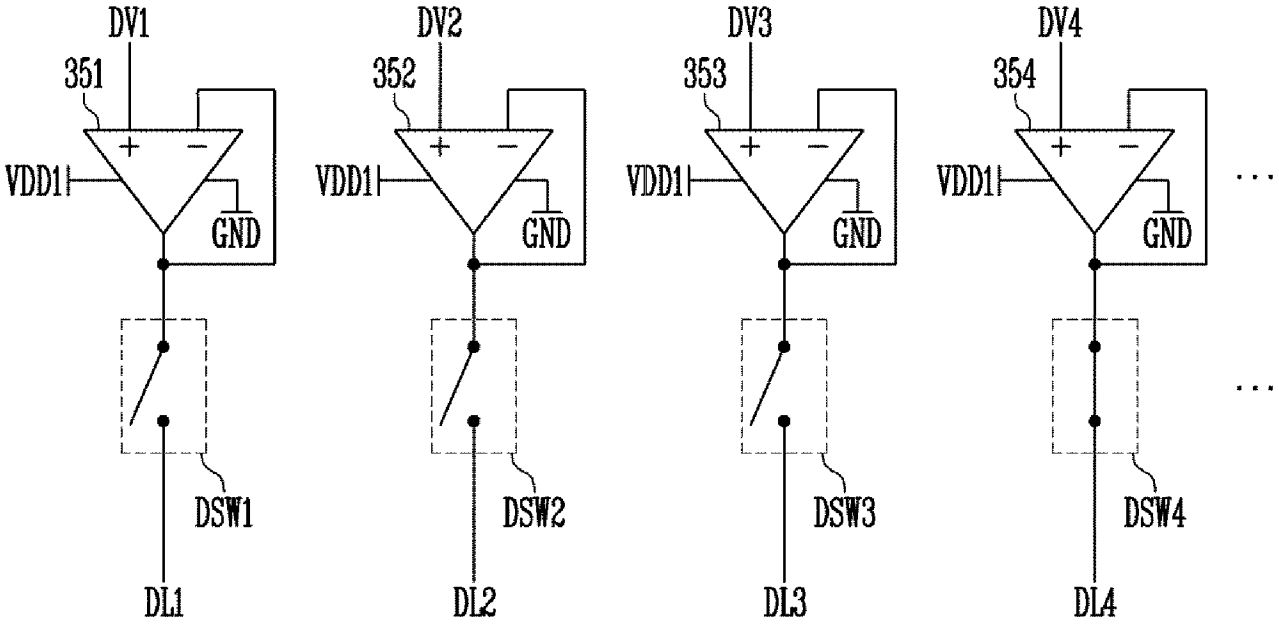
FIGS. 6A and 6B are diagrams illustrating an example of an operation of delay switches shown in FIG. 3, based on the waveform diagram shown in FIG. 5.
Figure 6B:
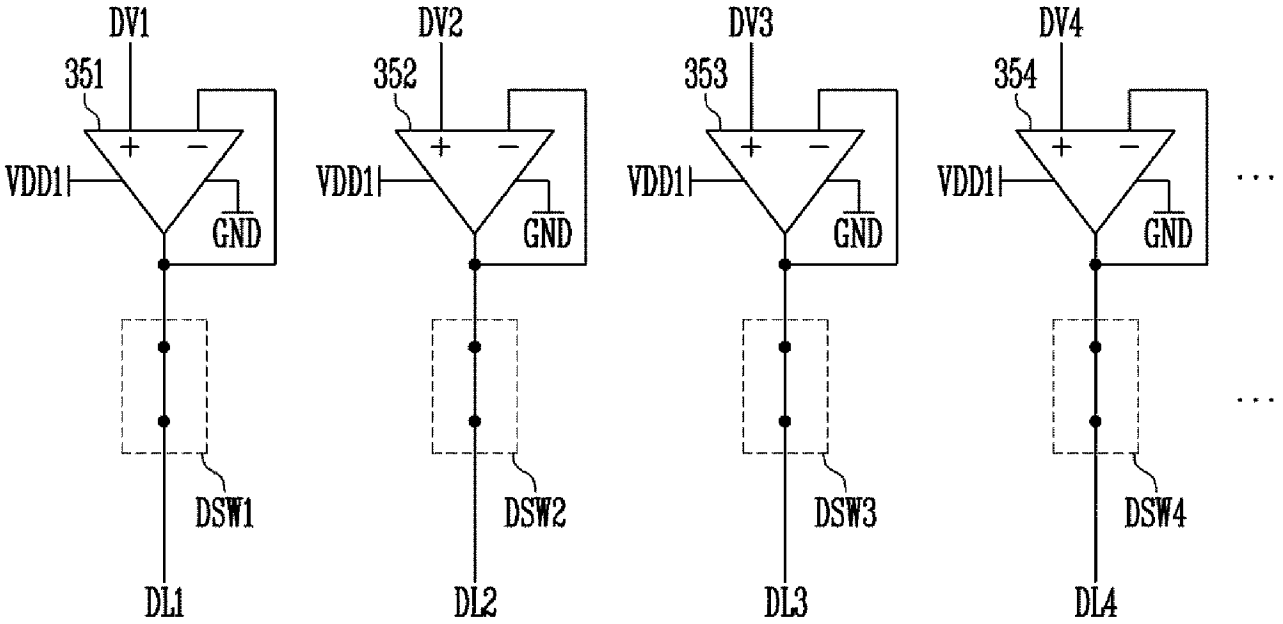

FIGS. 6A and 6B are diagrams illustrating an example of an operation of the delay switches shown in FIG. 3, based on the waveform diagram shown in FIG. 5.

Referring to FIGS. 3 to 6B, a timing at which a data signal is supplied according to a variation (or difference) in image data between a previous pixel row and a current pixel row may be individually controlled for each of the first to fourth data lines DL1 to DL4.

A variation in grayscale of image data corresponding to the first to third data lines DL1 to DL3 may be less than a threshold reference (e.g., a predetermined threshold reference), and a variation in grayscale of image data corresponding to the fourth data line DL4 may be greater than the threshold reference. As shown in FIGS. 5 to 6B, the first to third delay switches DSW1 to DSW3 may be turned off during the delay period DP, and may be turned on after the delay period DP. The fourth delay switch DSW4 may maintain the turn-on state even during the delay period DP. During the delay period DP, the first to third output buffers 351 to 353 and the first to third data lines DL1 to DL3 do not act as the load of the first power source VDD1.

Figure 7:
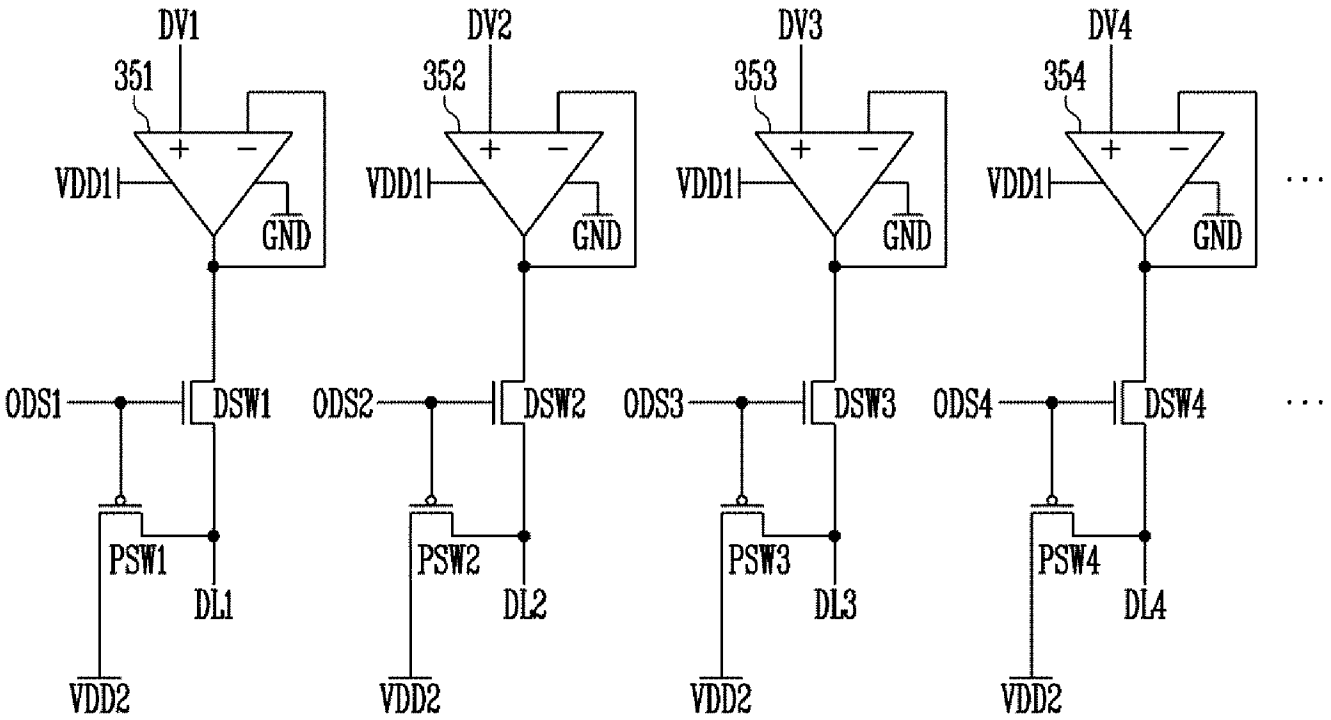
FIG. 7 is a diagram illustrating an example of a portion of the output buffers and the output controller, which are included in the source driver shown in FIG. 2.

FIG. 7 is a diagram illustrating an example of a portion of the output buffers and the output controller, which are included in the source driver shown in FIG. 2.

In FIG. 7, components identical to those described with reference to FIG. 3 are designated by like reference numerals, and their overlapping or repeated descriptions will be omitted. In addition, an output controller shown in FIG. 7 may have a configuration substantially identical to, or similar to, that of the output controller shown in FIG. 3, except for a pre-charge switch.

Referring to FIGS. 2, 3, and 7, the output controller 360 may include delay switches DSW1 to DSW4 and a delay determiner 364. The output controller 360 may further include pre-charge switches PSW1 to PSW4 respectively coupled to the data lines DL1 to DL4.

In an embodiment, the pre-charge switches PSW1 to PSW4 may be respectively coupled between the data lines DL1 to DL4 and a second power source VDD2 (e.g., a predetermined second power source). The pre-charge switches PSW1 to PSW4 may be turned on respectively in response to output delay signals ODS1 to ODS4. For example, a first pre-charge switch PSW1 may be coupled between the first data line DL1 and the second power source VDD2. The first pre-charge switch PSW1 may include a gate electrode supplied with a first output delay signal ODS1.

An embodiment in which the delay switches DSW1 to DSW4 are implemented with an NMOS (n-type metal oxide semiconductor) transistor, and in which the pre-charge switches PSW1 to PSW4 are implemented with a PMOS (p-type metal oxide semiconductor) transistor is illustrated in FIG. 7. In an embodiment, the delay switches DSW1 to DSW4 and the pre-charge switches PSW1 to PSW4 may share gate signals, respectively. That is, when a first delay switch DSW1 is turned on, the first pre-charge switch PSW1 may be turned off. When the first delay switch DSW1 is turned off, the first pre-charge switch PSW1 may be turned on.

However, this is merely illustrative, and gate electrodes of the pre-charge switches PSW1 to PSW4 may be coupled to a signal line for supplying separate control signals. The pre-charge switches PSW1 to PSW4 may operate complementarily with the delay switches DSW1 to DSW4, respectively.

In some embodiments, the pre-charge switches PSW1 to PSW4 may be turned on during a delay period DP. When the first pre-charge switch PSW1 is turned on, a voltage of the second power source VDD2 may be supplied to the first data line DL1. The voltage of the second power source VDD2 may be set to an intermediate level of the entire data voltage range. However, this is merely illustrative, and the voltage of the second power source VDD2 is not limited thereto.

A voltage (e.g., a predetermined voltage) may be pre-charged in a data line (e.g., a predetermined data line) by an operation of the pre-charge switches PSW1 to PSW4 during the delay period DP. Thus, the voltage of a data line supplied with a data signal after the delay period DP can rapidly reach a target voltage. Accordingly, the problem that the voltage of the data line does not reach the target voltage due to a temporarily high-impedance state of the output buffers can be prevented or can have the effects thereof reduced.

Figure 8:
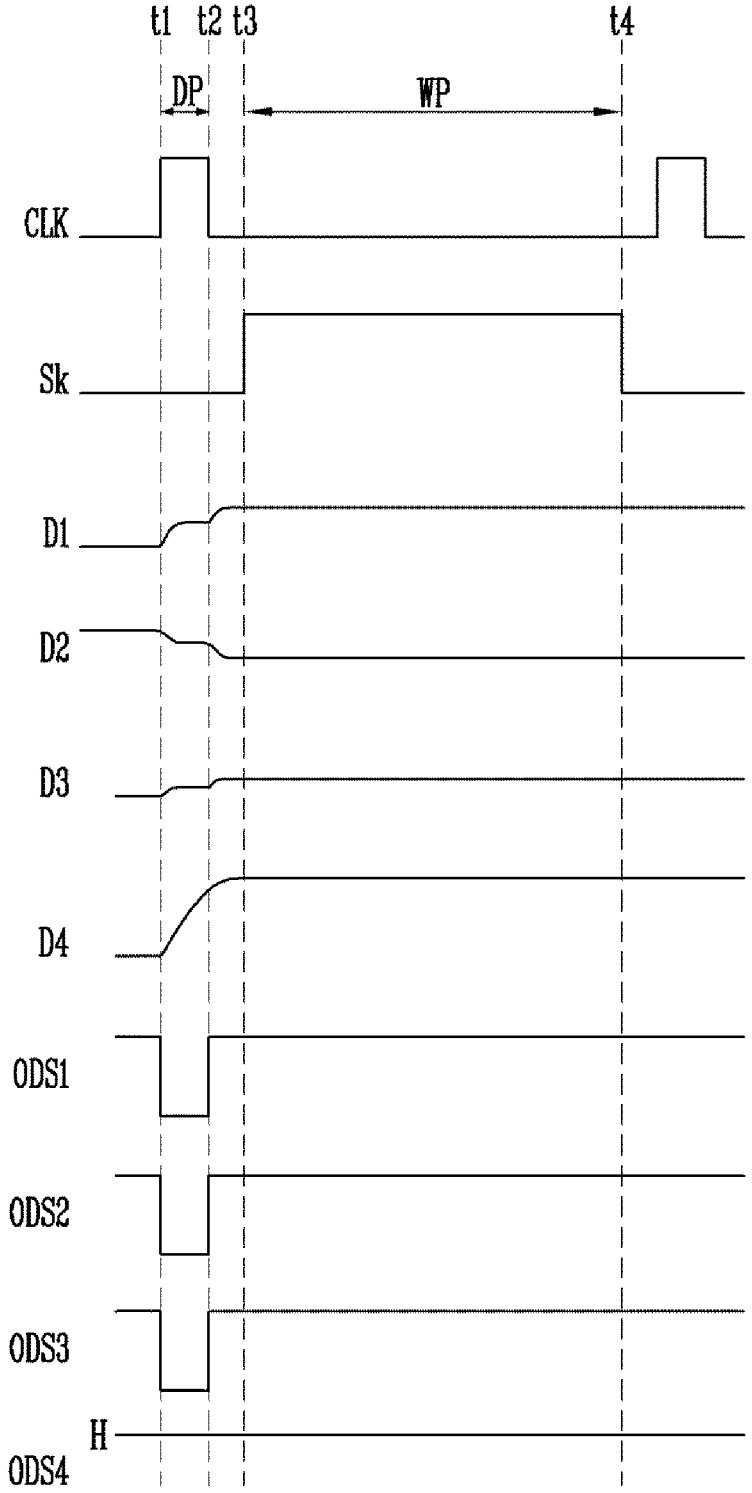
FIG. 8 is a waveform diagram illustrating an example of an operation of the output buffers and the output controller, shown in FIG. 7, which corresponds to the image data shown in FIG. 4.

FIG. 8 is a waveform diagram illustrating an example of an operation of the output buffers and the output controller, shown in FIG. 7, which corresponds to the image data shown in FIG. 4.

In FIG. 8, components identical to those described with reference to FIG. 5 are designated by like reference numerals, and their overlapping or repeated descriptions will be omitted.

Referring to FIGS. 4, 5, 7, and 8, when a scan signal Sk is supplied to the kth pixel row, the first to fourth data signals DV1 to DV4 may be written in some pixels of the kth pixel row through the first to fourth data lines DL1 to DL4.

During the delay period DP, first to third output delay signals ODS1 to ODS3 may be output, first to third delay switches DSW1 to DSW3 may be turned off, and first to third pre-charge switches PSW1 to PSW3 may be turned on. In addition, a fourth delay switch DSW4 may maintain the turn-on state, and the fourth pre-charge switch PSW4 may maintain the turn-off state.

A fourth data line voltage D4 may be charged as the fourth data signal DV4 supplied from the fourth output buffer 354 from a first time t1.

During the delay period DP, charging may be performed on the first to third data lines DL1 to DL3 by the second power source VDD2. Therefore, each of first to third data voltages D1 to D3 may be charged (e.g., to a predetermined voltage level).

Subsequently, at a second time t2, the first to third delay switches DSW1 to DSW3 may be turned on, and the first to third pre-charge switches PSW1 to PSW3 may be turned off. Thus, the first to third data line voltages D1 to D3 can be rapidly charged with the first to third data signals DV1 to DV3 supplied from the first to third output buffers 351 to 353, respectively. Accordingly, the problem that the voltage of the data line does not reach the target voltage due to a temporarily high-impedance state of the output buffers can be reduced or prevented.

Subsequently, at a third time t3, the first to fourth data line voltages D1 to D4 may correspond to the first to fourth data signals DV1 to DV4 (e.g., target voltages), respectively.

As described above, the source driver 300 and the display device 1000 having the same in accordance with the embodiment of the present disclosure can control at least some of the output buffers 350 to have the temporarily high-impedance state during the delay period DP based on a variation between image data of a previous pixel row and image data of a current pixel row. Accordingly, the equivalent resistance (or load) with respect to the first power source VDD1 is decreased, such that the voltage fluctuation of the first power source VDD1 for driving the output buffers 350 can be reduced or minimized. Thus, the voltage level change rate (slew rate or voltage charge rate) of a data signal (data line voltage) with respect to a grayscale change between pixel rows can be increased, and the image quality of the display device can be improved.

Embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present disclosure as set forth in the following claims, with functional equivalents thereof to be include therein.

What is claimed is:

1. A source driver comprising:

a plurality of output buffers configured to output data signals respectively corresponding to a plurality of data lines; and an output controller configured to control a timing at which one of the data signals corresponding to second image data begins to be transferred from one of the output buffers to one of the data lines based on a difference between first image data and the second image data, the first image data corresponding to a data signal supplied to a first pixel in a first pixel row, and the second image data corresponding to a data signal supplied to a second pixel included in a second pixel row that is different from the first pixel row, the first and second pixels being in a same pixel column.

2. The source driver of claim 1, wherein the first image data corresponds to a data signal supplied to a pixel in a (k−1)th pixel row, and wherein the second image data corresponds to a data signal supplied to a pixel in a kth pixel row, k being a natural number that is greater than 1.

3. A source driver comprising:

a plurality of output buffers configured to output data signals respectively corresponding to a plurality of data lines; and an output controller configured to control a timing at which each of the data signals corresponding to second image data is transferred from the output buffers to the data lines based on a difference between first image data and the second image data, the first image data corresponding to a data signal supplied to a first pixel in a first pixel row, and the second image data corresponding to a data signal supplied to a second pixel included in a second pixel row that is different from the first pixel row, wherein the output controller comprises:

a delay determiner configured to output an output delay signal based on results obtained by comparing the first image data and the second image data with a threshold reference; and a delay switch coupled between an output terminal of one of the output buffers and one of the data lines, and configured to be turned off in response to the output delay signal.

4. The source driver of claim 3, wherein, when a grayscale difference between the first image data and the second image data is less than a reference difference, the delay determiner is configured to output the output delay signal.

5. The source driver of claim 4, wherein, when the grayscale difference between the first image data and the second image data is greater than or equal to the reference difference, the delay switch is configured to maintain a turn-on state.

6. The source driver of claim 3, wherein a period in which the delay switch is turned off is shorter than one horizontal period.

7. The source driver of claim 3, wherein, when the delay switch is turned off, an output buffer corresponding to the delay switch is configured to have an electrically high-impedance state from a data line corresponding thereto.

8. The source driver of claim 3, wherein, when the first image data and the second image data are equal to or greater than a first reference grayscale, the delay determiner is configured to output the output delay signal.

9. The source driver of claim 8, wherein, when the first image data and the second image data are equal to or less than a second reference grayscale, the delay determiner is configured to output the output delay signal, and wherein the second reference grayscale is greater than the first reference grayscale.

10. The source driver of claim 9, wherein the delay switch is configured to be turned off during a delay period in response to the output delay signal.

11. The source driver of claim 9, wherein, when one of the first image data and the second image data is less than the first reference grayscale while the other of the first image data and the second image data is greater than the second reference grayscale, the delay switch is configured to maintain a turn-on state.

12. The source driver of claim 3, wherein the output controller further comprises a pre-charge switch coupled between the one of the data lines and a power source, and is configured to be turned on in response to the output delay signal.

13. The source driver of claim 12, wherein, during a delay period in which the delay switch is turned off, a voltage of the power source is supplied to a data line corresponding to the pre-charge switch among the data lines.

14. A display device comprising:

a display panel comprising a plurality of pixels;

a scan driver configured to supply a scan signal to the pixels in units of pixel rows; and a source driver configured to supply data signals to the pixels in response to the scan signal, and comprising:

a plurality of output buffers configured to output the data signals to a plurality of data lines, respectively; and an output controller configured to control a timing at which a current data corresponding to current image data begins to be transferred from one of the output buffers to one of the data lines based on a difference between previous image data and the current image data, the previous image data corresponding to a previous data signal supplied to a first pixel in a first pixel row, and the current image data corresponding to a current data signal supplied to a second pixel included in a second pixel row that is different from the first pixel row, the first and second pixels being in a same pixel column, wherein the output controller comprises:

a delay determiner configured to output an output delay signal based on a result obtained by comparing a grayscale difference between the previous image data and the current image data with a reference difference; and a delay switch coupled between an output terminal of one of the output buffers and one of the data lines, and configured to be turned off in response to the output delay signal.

15. The display device of claim 14, wherein the previous image data corresponds to a data signal supplied to a pixel in a (k−1)th pixel row, and wherein the current image data corresponds to a data signal supplied to a pixel in a kth pixel row, k being a natural number that is greater than 1.

16. The display device of claim 14, wherein, when the grayscale difference is less than the reference difference, the delay determiner is configured to output the output delay signal.

17. The display device of claim 14, wherein, when the grayscale difference is greater than or equal to the reference difference, the delay switch is configured to maintain a turn-on state.

18. The display device of claim 14, wherein, when the delay switch is turned off, an output buffer corresponding to the delay switch is configured to have an electrically high-impedance from a data line corresponding thereto.

* * * * *